US005749130A

United States Patent [19]

Bilyeu et al.

[11] Patent Number: 5,749,130

[45] Date of Patent: May 12, 1998

[54] CHILD-PROOF SEAT BELT BUCKLE ASSEMBLY

[76] Inventors: Paul D. Bilyeu, 1212 Sherwood Dr., Danville, Ind. 46122; Felicia M. Hinant, 530 W. 44th St., Indianapolis, Ind. 46208; James H. Hobby, 19040 Fairfield Blvd., Noblesville, Ind. 46060; Donel A. Hoffman, 2448 Fox Harbour South Dr., Indianapolis, Ind. 46227

[21] Appl. No.: 760,189

[22] Filed: Dec. 4, 1996

[51] Int. Cl.[6] ..... A44B 11/16

[52] U.S. Cl. ..... 24/637; 24/633; 24/603; 24/602; 24/636

[58] Field of Search ..... 24/633, 603, 602, 24/636, 637

[56] References Cited

U.S. PATENT DOCUMENTS

| | | | |
|---|---|---|---|
| 3,013,317 | 12/1961 | Weber | 24/637 |
| 3,181,215 | 5/1965 | Eberhart | 24/637 |
| 3,963,090 | 6/1976 | Hollins | 24/603 X |
| 4,385,425 | 5/1983 | Tanaka et al. | 24/633 |
| 4,432,119 | 2/1984 | Schwark et al. | 24/603 |
| 4,945,615 | 8/1990 | Anthony et al. | 24/573.5 |
| 4,955,115 | 9/1990 | Tanaka | 24/637 X |
| 5,005,267 | 4/1991 | Sugimoto | 24/637 |
| 5,067,211 | 11/1991 | van Riesen | 24/633 X |

*Primary Examiner*—James R. Brittain
*Assistant Examiner*—Stephen Vu
*Attorney, Agent, or Firm*—Woodard, Emhardt, Naughton, Moriarty & McNett

[57] ABSTRACT

A locking seat belt buckle assembly is configured for placement and operation within a standard seat belt buckle and tongue. In one embodiment, the seat belt buckle includes a latch that engages the tongue and a latch release plate to disengage the latch from the tongue upon depression of the release plate. The assembly includes a stop block that is movable by way of an actuator, such as a reversible micro-motor, to a position beneath the release plate to prevent depression of the latch plate. A pair of limit switches disconnect the motor from a power supply when contacted by the stop block at opposite ends of its travel. An indicator light is provided that is illuminated when the stop block is in position beneath the latch release plate. In one aspect, the motor is mounted within a housing with a spring disposed between the motor and the housing to bias the motor toward the release plate. In the event that the motor fails to retract the stop block from beneath the release plate, the stop block and motor can be manually pushed aside to compress the spring, thereby allowing depression of the release plate.

19 Claims, 3 Drawing Sheets

CHILD-PROOF SEAT BELT BUCKLE ASSEMBLY

BACKGROUND OF THE INVENTION

The present invention concerns a locking seat belt restraint assembly that prevents unintended or unauthorized release of a seat belt buckle. The invention has particular application in passenger vehicles, but can also be utilized in other circumstances in which a buckle assembly is utilized.

Within the last two decades, increasing numbers of state and federal regulations have been enacted requiring the use of seat belts in all passenger vehicles. Federal law has required the availability of seat belts in automobiles for many more years.

A problem has always existed with respect to child restraints within vehicles. Much of the focus in the development of child restraints has been on restraining car seats in an automobile seat. There has been very little attention paid to the safety of young children who are too heavy or large for car seats yet cannot trusted in a standard automobile seat belt. Most of the attention in this regard has been devoted to sizing the seat belt to fit smaller children, and to the refinement of shoulder restraints.

Certainly, it is not uncommon for the parents of small children to discover that their child has somehow managed to unbuckle their own seat belt. If the driver of the vehicle is unaware that the child has unbuckled his/her own seat belt, the safety of the child is compromised. If the driver becomes aware while driving, it is usually inconvenient to reach to the child's seat to re-attach the seat belt buckle, particularly if the child is in the back seat of the automobile. Moreover, the driver may be constantly distracted by the possibility that the child will unbuckle his/her seat belt.

It is almost a law of nature that any device that is created as an adjunct to an existing seat belt can be suprisingly easily dismantled by even the smallest child. Simply wrapping the seat belt in some covering has proven time and again to be inadequate to evade the prying fingers of a toddler. On the other hand, adjunct devices that are "child-proof" typically prove to be "adult-proof" as well.

There remains a need, therefore, for a locking device that will prevent a child of any age from unbuckling the seat belt prematurely. The need extends to other persons who might be likely to try to release a buckle assembly, such as prisoners and mentally handicapped persons. This need must be satisfied by a device that can be readily and easily activated and deactivated by an adult.

SUMMARY OF THE INVENTION

The present invention addresses this need in the provision of a locking seat belt assembly that is incorporated into the seat belt buckle apparatus itself. In one embodiment, the chassis of a seat belt buckle is modified to support an acutator, such as a micro-motor. The actuator extends and retracts a stop block. The stop block is configured to extend underneath the latch release plate of the seat belt buckle apparatus. With the stop block in position, the release plate cannot be pushed down to thereby release the tongue from the mating portion of the seat belt.

In one specific embodiment, a pair of limit switches control the activation of the actuator so that the stop block does not over-extend or over-retract. In a further aspect of the invention, the actuator is contained within a housing mounted to the chassis of the seat belt buckle. A return spring is positioned between the actuator and the housing to push the actuator toward the latch release plate of the seat belt buckle. The spring is only partially compressed within the actuator housing and can be completely depressed to a much smaller length. In this aspect of the invention, in the event that the electrical components of the assembly fails, the stop block can be manually retracted away from the release plate by pushing the block and thereby pushing the actuator against the operation of the spring.

In a further feature of the invention, a switch is provided separate from the seat belt buckle assembly that allows activation of the actuator and stop block. In a preferred embodiment, an LED can be is visible on the seat belt itself to indicate that the locking assembly is in its locked operative condition. Alternatively, the LED can be integrated into the vehicle annunciator panel at the vehicle dashboard. In yet another aspect of the preferred embodiment, the actuator is controlled by an actuator controller circuit which is powered from the vehicle battery. In the event of a failure of the vehicle electrical system, a back-up battery can be included in the actuator controller circuit to provide back-up power to either extend or retract the stop block of the assembly.

One object of the invention is to provide a locking apparatus to hold a seat belt buckle assembly in its locked and latched position. Another object is to provide a system that can be remotely powered and controlled so that it is inaccessible to the child to be restrained.

One benefit of the invention is that the components are small enough to sit within the envelope of a typical seat belt buckle assembly. Another benefit is that a back-up power system is provided so that the apparatus can be de-activated when required. A further benefit is that the locking assembly provides a means for manually releasing the assembly that can be extremely difficult, if not impossible, for release by a child. Other objects and benefits of the present invention will become apparent from the following written description and accompanying figures.

DESCRIPTION OF THE PREFERRED EMBODIMENT

Figures 1, 2, 5:
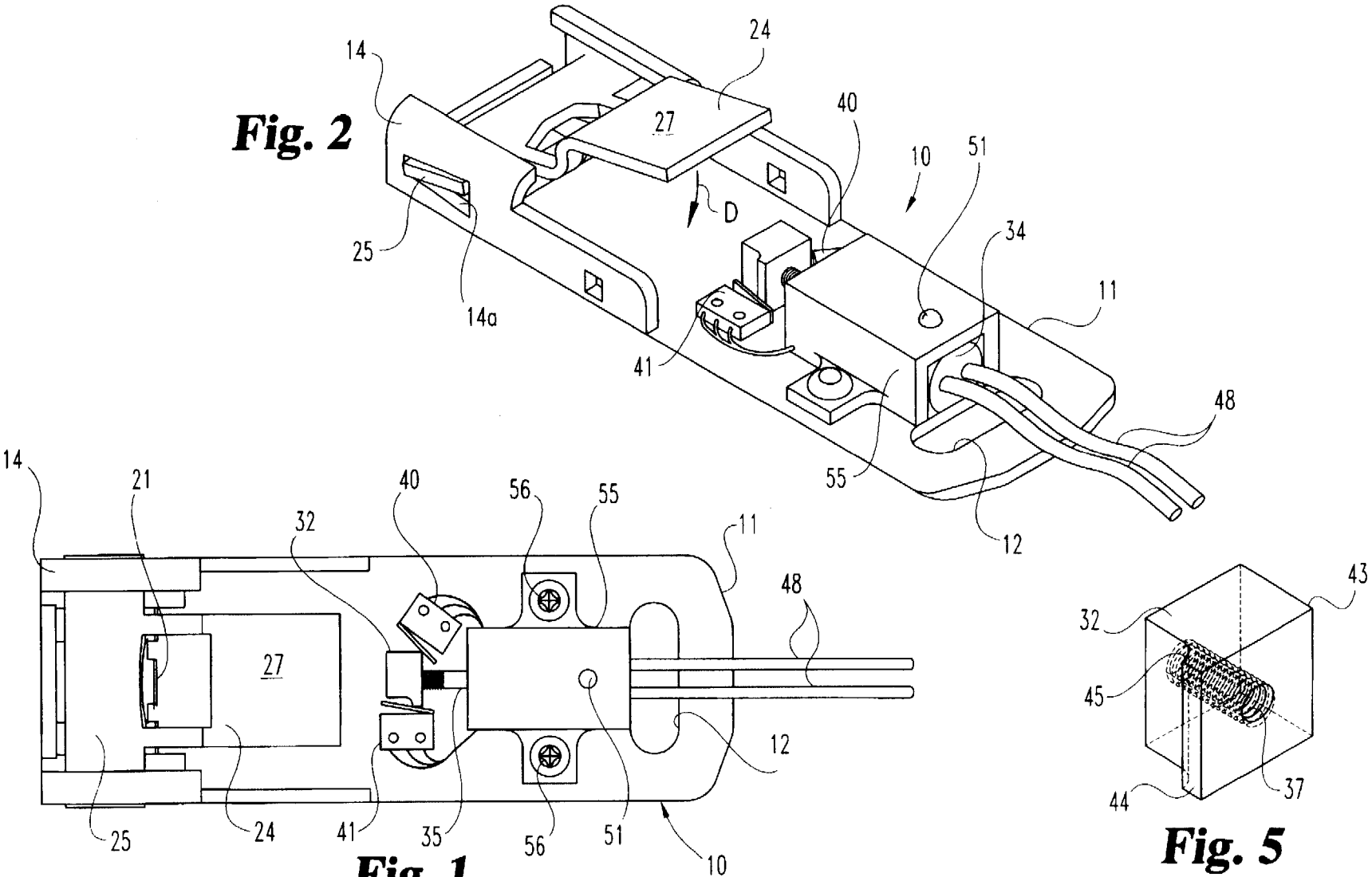
FIG. 1 is a top elevational view of a seat belt buckle with the latch components and the locking assembly according to one embodiment of the present invention mounted thereon.
FIG. 2 is perspective view of the seat belt buckle depicted in FIG. 1.
FIG. 5 is a perspective view of a stop block in accordance with one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any alterations and further modifications in the described device, and any further applications of the principles of the invention as described herein are contemplated as would normally occur to one skilled in the art to which the invention relates.

Figure 3:
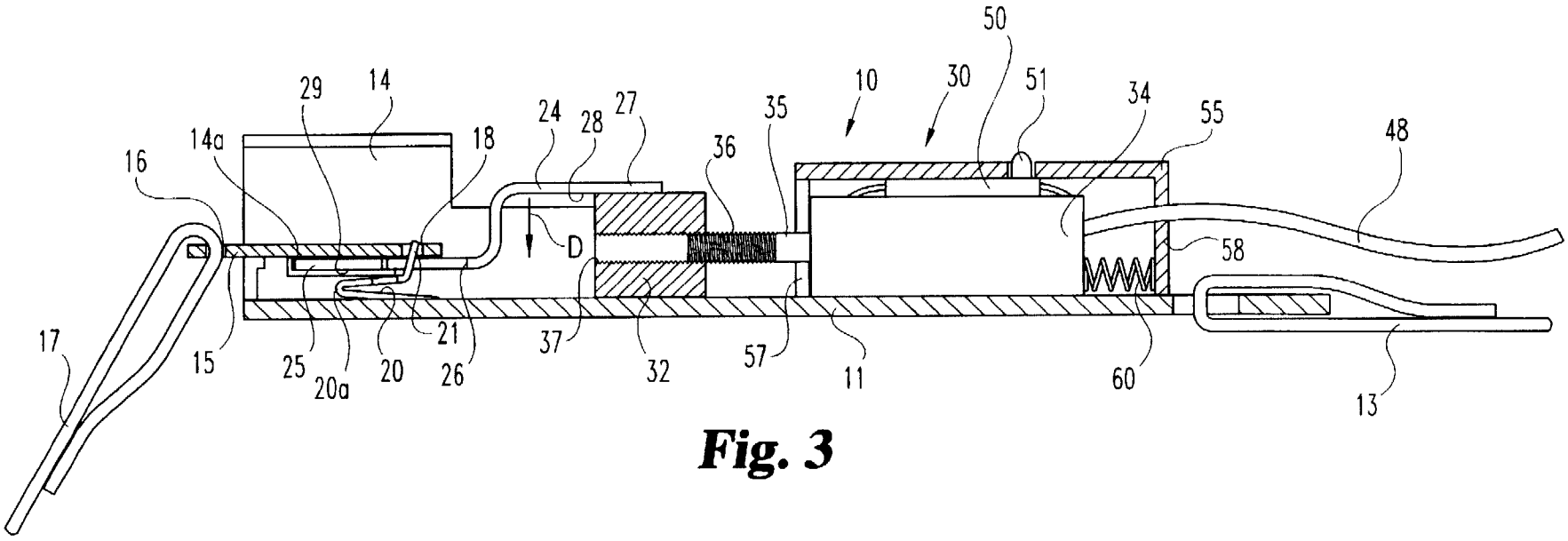
FIG. 3 is a side partial cross-sectional view of the seat belt buckle assembly shown in FIGS. 1 and 2.

A locking seat belt buckle assembly 10 in accordance with one embodiment of the present invention is depicted in FIGS. 1–3. The assembly 10 includes a chassis 11 which is preferably configured similar to a chassis for a typical seat belt buckle. In accordance with a preferred embodiment, the chassis can be lengthened somewhat from the length of a typical seat belt buckle in order to accommodate the additional components of the assembly 10.

The chassis 11 defines an aperture 12 at one end through which a seat belt web 13 (FIG. 3) extends. The chassis also defines a pair of side plates 14 having opposite pivot slots 14*a* extending therethrough. The side plates are configured to house the latching mechanism of the seat belt buckle and to operate as a guide for the tongue 15 of the seat belt buckle apparatus.

The tongue 15 can be of one standard automotive design to include a web aperture 16 through which a second seat belt web 17 extends. The tongue 15 further defines a latch slot 18 that is situated within the chassis 11 of the seat belt buckle for latching engagement with a latch 20. The latch 20 preferably includes a locking arm 21 that is configured to project into the latch slot 18 of the tongue 15. In one typical buckle design, the latch 20 is in the form of a bent spring so that the latch 20 includes a bend 20*a* that can be readily deflected to move the locking arm 21 into and out of the latch slot 18 of the tongue 15.

The assembly 10 further includes a release plate 24 that is disposed between the tongue 15 and the latch 20. Preferably, the release plate 24 defines a pivot plate 25 that extends into the pivot slots 14*a* of the chassis side plates 14. The pivot plate 25 is dimensioned relative to the pivot slots 14*a* so that the plate 25 can pivot as the release plate 24 is pushed in the direction of the arrow D shown in FIGS. 2 and 3.

In one seat belt configuration, the release plate 24 defines a latch aperture 26 that is oriented directly above the locking arm 21 of the latch 20 and in alignment with the latch slot 18 of the tongue 15 when the tongue is pushed into the chassis 11. The release plate 24 further includes a release surface 27 that is pressed to pivot the plate about the pivot plate 25. Preferably, the release surface 27 is engaged by a button (not shown) that is mounted within the cover of a typical seat belt buckle assembly. The release plate 24 also includes a bottom surface 28 directly beneath the release surface 27 and a second bottom surface 29 that contacts the latch 20 just past the bend 20*a*. The positioning, configuration and operation of the release button on a typical seat belt is well known to persons skilled in the art. For example, the locking arm 21 can be formed as part of the release plate 24 in lieu of the latch aperture 26. In this configuration, the latch 20 is modified to form a return spring to push the release plate 24 up toward the tongue 15.

Thus far, the described components can be configured in accordance with automotive industry standards for seat belt assemblies. For the purposes of the present invention, one embodiment of a seat belt assembly is depicted, it being understood that the invention can be used with other seat belt designs in which a release plate is depressed to release the seat belt tongue from the latch. According to the illustrated embodiment, as the release plate 24 is depressed, it pivots about the pivot plate 25 within the pivot slots 14*a*. In this manner, the plate 24 moves in the direction of the arrow D. The second bottom surface 29 then depresses the latch 20 by causing the latch to deflect about its bend 20*a*. As the latch 20 is deflected downward, the locking arm 21 disengages the latch slot 18 of the tongue 15, thereby allowing the tongue to be removed. It is this action that the present invention seeks to prevent.

In accordance with one embodiment of the present invention, a stop block 32 is provided that can be moved into position beneath the release plate 24. In this manner, when the release plate 24 is depressed its bottom surface 28 contacts the stop block 32, as depicted in FIG. 3. In this position, the release plate 24 cannot be moved any further in the direction of the arrow D. Consequently, the release plate 24 is unable to depress the latch 20 far enough to allow the locking arm 21 to release from the latch slot 18 of the tongue 15. With the latch 20 in its locked position, the tongue cannot be disengaged from the seat belt buckle assembly, no matter how hard or rapidly the release plate 24 is depressed by the child.

In a most preferred embodiment of the invention, the assembly 10 is provided with an actuator, such as a micro-motor 34, mounted to the chassis 11. The micro-motor 34 includes a rotating drive shaft 35 having a threaded end 36. The stop block 32 is provided with internal mating threads 37 which are configured to mate with the threaded end 36 of the micro-motor 34. The stop block 32 and micro-motor 34 are configured so that as the drive shaft 35 rotates, the stop block 32 travels upwards or downwards along the threaded end 36 of the drive shaft 35 by rotation of the threaded end 36 relative to the mating threads 37.

The stop block 32 and drive shaft 35 are dimensioned so that the stop block 32 can extend to a distance sufficient to position it beneath the bottom surface 28 of the release plate 24 and can retract a distance sufficient to clear the release plate 24 (see FIG. 1). Of course, in the extended position, the seat belt buckle cannot be released, while in the retracted position, the release plate 24 can be freely depressed. The threads on the drive shaft threaded end 36 and mating threads 37 can have a variety of configurations. In a specific embodiment, the threads are standard 4–40×⅜ screw threads. The thread form can determine the amount of time it takes to extend or retract the stop block 32. It is preferred that the stop block 32 move between its extended and retracted positions in less than ten (10) seconds, and most preferably less than five (5) seconds. Preferably, some form of lubricant is disposed between the threads so that the stop block 32 slides easily underneath the release plate 24. Although not depicted in the figures, some form of guide rail can be provided to guide the path of the stop block as it extends and retracts.

In accordance with the preferred embodiment, the micro-motor 34 is a reversible motor, meaning that its drive shaft 35 can rotate in both directions. Thus, the micro-motor 34 can either extend or retract the stop block 32 based upon the direction of rotation of the drive shaft 35. In one direction, the threaded end 36 of the drive shaft is threaded into the stop block 32, thereby retracting the block. In an opposite direction of rotation, the threaded end 36 attempts to unthread from the stop block, thereby pushing the block underneath the release plate 24. In order to control the movement of the stop block 32, a pair of limit switches 40 and 41 are provided. The limit switch 40 controls the amount of retraction of the stop block 32. Once the stop block retracts to a position in which the limit switch 40 is closed, a signal is provided to shut off the micro-motor 34. Likewise, the limit switch 41 controls the amount of extension of the stop block 32 so that when the block closes the switch 41 it also sends a signal to shut off the micro-motor 34.

Preferably, the limit switches 40 and 41 are disposed generally adjacent each other. In this manner, the seat belt buckle assembly 10 can be limited to the smallest package possible. As can be seen from FIG. 1, the closure direction for the switches 40, 41 is arranged to take advantage of the limited travel of the stop block 32.

In one preferred embodiment, the stop block 32 has a configuration as shown in FIG. 5. In particular, the block 32 includes a trailing edge 43 that bears against the first limit switch 40 when the stop block is in its retracted position. The stop block 32 can also include leading edge 44 which is configured to contact the second limit switch 41 when the stop block is fully extended. A leading surface 45 is provided adjacent the leading edge 44. In one specific embodiment, this surface is curved so that the leading edge 44 can be re-engaged with the limit switch 41 in the event that the stop block 32 retracts beyond the end of the limit switch 41. It is understood that other configurations for the stop block 32 can be contemplated based upon the arrangement of the limit switches 40, 41. In the preferred embodiment, the edges 43 and 44 are rounded to reduce the amount of wear on the contacts of the limit switches 40 and 41.

Referring to the side view in FIG. 3, the motor 34 is controlled by the controller circuit 50. In one embodiment, components of the actuator controller circuit 50 can be disposed adjacent the motor. Electrical leads from the limit switches 40 and 41 are fed to the actuator controller circuit. In addition, power supply wires 48 take power, preferably from the vehicle battery, and supply it to the motor 34, preferably by way of the controller circuit 50.

Figure 4:
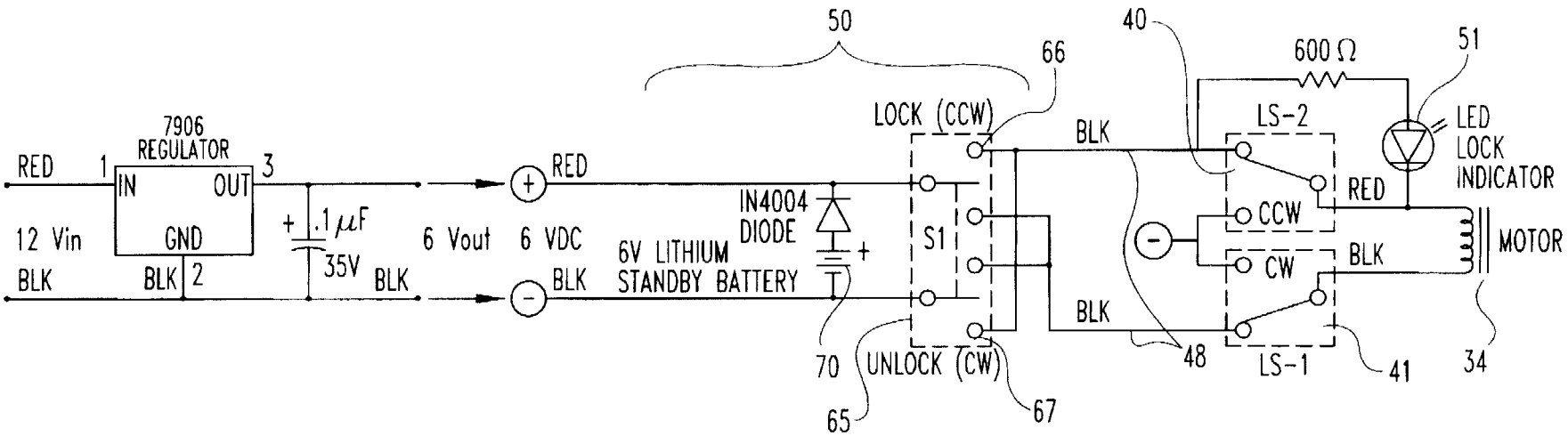
FIG. 4 is an electrical schematic of a motor controller circuit for use in accord one embodiment of the present invention.

One specific embodiment of the actuator controller circuit 50 is shown in FIG. 4. In this embodiment, the motor 34 is identified at the right of the schematic, while a standard 12 volt DC input from a automobile battery is shown on the left side. Preferably, the 12 volt input is regulated to 6 volts to be supplied to the micro-motor 34. In one aspect of the invention, a back-up battery 70 is provided in parallel with the 6 volt regulated vehicle supply. In the event that the vehicle power supply fails, the back up battery will power the actuator controller circuit 50. Preferably, the back up battery 70 is a 6 volt lithium battery.

In a further feature of the invention, an activation switch 65 is provided to activate or de-activate the locking assembly 10. The switch can be preferably a linear switch having two positions. In a first position 66, the actuator controller circuit feeds power to the motor 34 so that the motor rotates in a particular direction to lock the assembly. In one specific embodiment, the power provided to the motor 34 causes it to rotate in a counter-clockwise direction when the switch 65 is in the first position. In a second position 67, the switch 65 feeds power to cause the motor to rotate in the opposite, or clockwise, direction to unlock the assembly—i.e., to retract the stop block 32. Preferably, the switch 65 is a two-position switch so that the switch remains in contact with the appropriate leads at either the locked position 66 or the unlocked position 67. In this way, electrical power is fed through line 48 to the motor by way of the limit switches whether the switch 65 is in the first or the second position. It is contemplated that the switch 65 can include a third manual over-ride position (not shown) in which the switch is grounded to stop the flow of electricity to the limit switches and motor, to thereby prevent operation of the child-proof aspects of the seat belt buckle assembly.

In the specific embodiment, the power supply wires 48 provide power to the motor 34 through each of the limit switches 40 and 41. In the configuration depicted in FIG. 4, the limit switches close the circuit between the motor and the power supply so that electricity is fed to the motor. A lock indicator light 51, such as an LED, is connected in parallel with limit switch 41 so that when power is fed through the limit switch 41 the light is illuminated, thereby indicating that the motor has been rotated in its counter-clockwise direction to push the stop lock 32 beneath the release plate 24. When the stop block is retracted to close the limit switch 41, the first limit switch 40 is opened to terminate electrical power to the indicator light 51. In accordance with the circuit diagram of FIG. 4, as long as the two limit switches 40 and 41 engage a respective one of the power supply wires 48, power is continuously fed to the motor 34. Once the stop block 32 contacts one of the limit switches 40 or 41, the switch is de-activated, thereby opening the power supply circuit to ground so that the motor 34 stops.

In the illustrated embodiment, the LED indicator light 51 is disposed on the buckle itself to provide an immediate indication that the locking mechanism is activated. Alternatively, the indicator light 51 can be incorporated into the vehicle annunciator panel, such as a dashboard light, so that the driver has a continuous indication that the locking assembly is engaged even while driving.

In a further aspect of the preferred embodiment, the micro-motor 34 can be disposed within an actuator housing 55. The actuator housing 55 is mounted to the chassis 11 by way of fasteners 56. The housing includes a front wall 57 that has an opening through which the drive shaft 35 can extend. The housing also includes a back wall 58 that is substantially closed except for openings to receive the power supply wires 48. The housing 55, and preferably the front wall 57, can include additional openings for the electrical wires leading to and from the two limit switches 40 and 41.

In one aspect of the invention, a return spring 60 is disposed between the back wall 58 of the housing 55 and the micro-motor 34. The return spring 60 pushes the motor 34 against the front wall 57 toward the release plate 24. The return spring 60 provides a fail-safe aspect for the locking seat belt buckle assembly 10. For example, when the stop block 34 is fully extended and the motor is not operational to retract the block, the seat belt buckle would be "stuck" in its locked position. Under these circumstances, the vehicle operator would be unable to release the seat belt buckle assembly 10 from around the child. Consequently, a fail-safe feature is important in the event of a failure of the actuator or electrical power supply of the system.

This fail-safe feature is embodied in the ability of the return spring 60 to be compressed against the back wall 58 of the housing 55. This compression of the spring 60 allows backward travel of the motor, so that the stop block 32 can be moved from beneath the release plate 24. In one specific embodiment, the stop block 32 can be contacted through appropriate openings (not shown) in the housing of the seat belt to allow the stop block to manually pushed back against the spring. The vehicle operator can use a key or a similar elongated object to push the stop block 32 back against the force of the spring.

The travel permitted by the spring 60 is sufficient for the stop block 32 to clear the release plate 24 even when the block is at its full extended position. In this specific embodiment, a single spring 60 is provided that is calibrated to require only a nominal force to fully compress. It is of course contemplated that other resilient components can be disposed between the motor 34 and the housing 55. In addition, other configurations which permit resiliently biasing the electric motor toward the latch engagement position are contemplated, provided that the other means can be resiliently deformed to allow movement of the stop block 32 away from the release plate 24. Most preferably, the openings provided in the seat belt buckle cover are too small for a child to insert his/her fingers, yet large enough to accept a standard automobile ignition key.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

For example, one preferred micro-motor has a rated voltage of 6 volts and a rated torque of 4.9 N-cm. The motor can have a rated speed of 40 rpm at 170 micro amps to permit rapid engagement and disengagement of the stop block 32 with the release plate 24. Alternative micro-motors can be provided with different rated voltages, speeds, torques and currents. It is of course understood that the motor is preferably small so that it can fit within the small package of a seat belt buckle assembly.

The present invention also contemplates the use of a linearly actuated motor, such as a solenoid, rather than a rotary shaft motor. In the case of a linearly actuated motor or solenoid, the travel of the actuator pin must be sufficient to push the stop block underneath and pull it away from the release plate 24. The invention also contemplates the use of various other actuators in lieu of the micro-motor described above.

In accordance with one feature of the preferred embodiment, the chassis can have a length of 4.85 inches, which is 1–2 inches longer than a typical seat belt buckle assembly. Certainly, different arrangements for the components or further miniaturization of the components can allow for a smaller seat belt chassis size.

In accordance with one embodiment of the invention, the switch 65 to activate the mechanism to locked or unlocked position can be oriented on the vehicle dashboard. It is contemplated that the switch can be situated at other locations in the vehicle, including at the seat belt itself. Of course, locating the release electrical switch at the seat belt buckle may tend to defeat the purpose of the locking restraint assembly of the present invention.

It is also contemplated that the switch 65, and particularly the unlocked position 67 of the switch, can be tied into the vehicle ignition system. In this aspect, it is contemplated that the switch 65 would be automatically moved to the unlocked position 67 when the vehicle ignition is turned on. In this respect, separate activation of the switch may not be necessary when the car is stopped. It is further contemplated that the switch 65 can be associated with the position of the gear shift selection lever. In other words, the switch 65 can be oriented to be inactive to unlock the assembly when the vehicle is in drive. Various other arrangements for the actuator controller circuit 50 and the switch 65 can be provided depending upon the degree of safety and fail-safe certainty desired. In a further variation, the actuator controller circuit can be modified to automatically move the stop block to its release position away from the release plate upon termination of electrical power to the circuit. For example, the circuit can sense the loss of electrical power and provide electricity from a storage device, such as a capacitor, to to the actuator to thereby retract the stop block.

What is claimed:

1. A locking seat belt buckle assembly, comprising:

a tongue;

a latch;

locking means between said tongue and said latch to lock said tongue to said latch;

latch release means for releasing said locking means to permit disengagement of said tongue from said latch, said latch release means including a release plate pivotably mounted to said chassis to be depressed from outside the seat belt buckle assembly to release said locking means;

stop means operable on said latch release means to prevent operation of said latch release means; and a chassis for supporting said latch, said locking means, said latch release means and said stop means, wherein said stop means includes a stop block slidably disposed between said chassis and said release plate to move between a first position in which said stop block prevents depression of said release plate and a second position in which said stop block does not prevent depression of said release plate.

2. The locking seat belt buckle assembly according to claim 1, further comprising;

a switch remote from said stop means, said switch having two positions, one position corresponding to said first position of said stop block and another position corresponding to said second position of said stop block.

3. A locking seat belt buckle assembly, comprising:

a tongue;

a latch;

locking means between said tongue and said latch to lock said tongue to said latch;

latch release means for releasing said locking means to permit disengagement of said tongue from said latch;

stop means operable on said latch release means to prevent operation of said latch release means; and a chassis for supporting said latch, said locking means, said latch release means and said stop means, wherein said stop means includes;

a stop block slidably disposed between said chassis and said release plate to move between a first position in which said stop block prevents depression of said release plate and a second position in which said stop block does not prevent depression of said release plate; and an electrically controlled actuator operably coupled to said stop block to move said stop block between said first and second positions.

4. The locking seat belt buckle assembly according to claim 3, wherein said stop means includes:

an electrical circuit to provide electrical power from a power source to said actuator; and a pair of limit switches forming part of said electrical circuit and supported on said chassis to be closed by said stop block in said first and second positions, respectively, said limit switches being configured to terminate electrical power to said actuator when either of said limit switches is closed by said stop block.

5. The locking seat belt buckle assembly according to claim 3, wherein:

said actuator is a rotary motor having a rotating drive shaft;

said stop block includes an internal bore to receive said drive shaft therein; and drive means between said drive shaft and said internal bore to convert rotation of said drive shaft to linear movement of said stop block.

6. The locking seat belt buckle assembly according to claim 5, wherein said drive means includes mating threads between said drive shaft and said internal bore.

7. A locking seat belt buckle assembly, comprising:

a tongue;

a latch;

locking means between said tongue and said latch to lock said tongue to said latch;

latch release means for releasing said locking means to permit disengagement of said tongue from said latch;

stop means operable on said latch release means to prevent operation of said latch release means;

a chassis for supporting said latch, said locking means, said latch release means and said stop means; and a switch remote from said stop means, said switch operable to activate said stop means to prevent operation of said latch means.

8. A locking seat belt buckle assembly, comprising:

a tongue;

a latch;

locking means between said tongue and said latch to lock said tongue to said latch;

latch release means for releasing said locking means to permit disengagement of said tongue from said latch;

stop means operable on said latch release means to prevent operation of said latch release means; and a chassis for supporting said latch, said locking means, said latch release means and said stop means, wherein said stop means includes;

a stop block slidably disposed between said chassis and said release plate to move between a first position in which said stop block prevents depression of said release plate and a second position in which said stop block does not prevent depression of said release plate;

an electrically controlled actuator operably coupled to said stop block to move said stop block between said first and second positions; and resilient means for biasing said actuator toward said first position of said stop block, said resilient means being compressible to push said actuator in a direction away from said first position of said stop block.

9. The locking seat belt buckle assembly according to claim 8, wherein:

said chassis includes a housing mounted thereon, said housing sized to receive said actuator therein; and said resilient means includes a spring disposed between said actuator and said housing to bias said actuator towards said first position of said stop block.

10. The locking seat belt buckle assembly according to claim 3, wherein said stop means further includes:

an electrical circuit to supply electrical power from an external power source to said actuator; and a back-up battery connected to said electrical circuit to supply electrical power to said actuator upon a loss of electrical power from said external source.

11. The locking seat belt buckle assembly according to claim 3, wherein:

said actuator is a reversible motor operable in a first direction to move said stop block to said first position and in a second direction to move said stop block to said second position; and an electrical circuit to supply electrical power from a power source to said motor, said electrical circuit including;

a switch to supply electrical power to said motor to selectively operate in said first direction or said second direction; and an indicator light electrically connected to illuminate when said switch supplies power to said motor to operate in said first direction.

12. A locking mechanism for use in a buckle assembly having a tongue, a latch engageable with the tongue, a latch release plate operable to release the tongue from the latch, and a chassis supporting the latch and latch release plate, said locking mechanism comprising:

a stop block slidably disposed on the chassis to move between a first position in which said stop block prevents operation of the release plate and a second position in which said stop block does not prevent operation of the release plate; and an electrically controlled actuator operably coupled to said stop block to move said stop block between said first and second positions.

13. The locking mechanism for use in a buckle assembly according to claim 12, wherein said stop means includes:

an electrical circuit to provide electrical power from a power source to said actuator; and a pair of limit switches forming part of said electrical circuit and supported on the chassis to be closed by said stop block in said first and second positions, respectively, said limit switches being configured to terminate electrical power to said actuator when either of said limit switches is closed by said stop block.

14. The locking mechanism for use in a buckle assembly according to claim 12, wherein:

said actuator is a rotary motor having a rotating drive shaft;

said stop block includes an internal bore to receive said drive shaft therein; and drive means between said drive shaft and said internal bore to convert rotation of said drive shaft to linear movement of said stop block.

15. The locking mechanism for use in a buckle assembly according to claim 14, wherein said drive means includes mating threads between said drive shaft and said internal bore.

16. The locking mechanism for use in a buckle assembly according to claim 12, further comprising a switch remote from said stop means, said switch operable to activate said stop means.

17. The locking mechanism for use in a buckle assembly according to claim 12, wherein said stop means includes resilient means for biasing said actuator toward said first position of said stop block, said resilient means being compressible to push said actuator in a direction away from said first position of said stop block.

18. The locking mechanism according to claim 12, wherein said stop means further includes;

an electrical circuit to supply electrical power from an external power source to said actuator; and a back-up battery connected to said electrical circuit to supply electrical power to said actuator upon a loss of electrical power from said external source.

19. The locking mechanism according to claim 12, wherein:

said actuator is a reversible motor operable in a first direction to move said stop block to said first position and in a second direction to move said stop block to said second position; and an electrical circuit to supply electrical power from a power source to said motor, said electrical circuit including;

a switch to supply electrical power to said motor to selectively operate in said first direction or said second direction; and an indicator light electrically connected to illuminate when said switch supplies power to said motor to operate in said first direction.

* * * * *